US006792790B2

(12) United States Patent
Ritter

(10) Patent No.: US 6,792,790 B2
(45) Date of Patent: Sep. 21, 2004

(54) ARRANGEMENT FOR REMOVING DENTS IN SHEET METAL

(75) Inventor: Olaf Ritter, Forchtenberg (DE)

(73) Assignee: Adolf Wurth GmbH & Co. KG, Kunzelsau (DE)

( * ) Notice: Subject to any disclaimer, the term of this patent is extended or adjusted under 35 U.S.C. 154(b) by 0 days.

(21) Appl. No.: 10/169,649

(22) PCT Filed: Dec. 15, 2000

(86) PCT No.: PCT/EP00/12778

§ 371 (c)(1),
(2), (4) Date: Sep. 5, 2002

(87) PCT Pub. No.: WO01/49428

PCT Pub. Date: Jul. 12, 2001

(65) Prior Publication Data

US 2003/0101791 A1 Jun. 5, 2003

(30) Foreign Application Priority Data

Jan. 4, 2000 (DE) ..... 200 00 085

(51) Int. Cl.[7] ..... B21J 13/08
(52) U.S. Cl. ..... 72/458; 72/466.6; 72/705
(58) Field of Search ..... 72/457, 458, 465.1, 72/466.6, 705, 479, 480

(56) References Cited

U.S. PATENT DOCUMENTS

| | | | | | |
|---|---|---|---|---|---|
| 2,799,190 | A | * | 7/1957 | Awot | 72/458 |
| 2,852,971 | A | * | 9/1958 | Macaluso, Jr. | 72/458 |
| 2,957,376 | A | * | 10/1960 | Parisi | 72/458 |
| 3,091,983 | A | * | 6/1963 | Kliss | 72/458 |
| 4,050,271 | A | * | 9/1977 | Jones | 72/37 |
| 4,116,035 | A | * | 9/1978 | Malarsky | 72/389.6 |
| 4,503,701 | A | * | 3/1985 | Hardy | 72/372 |
| 4,507,951 | A | * | 4/1985 | Hultquist | 72/431 |
| 4,930,335 | A | * | 6/1990 | Ishihara | 72/451 |
| 5,951,818 | A | * | 9/1999 | Gaetano | 156/535 |

FOREIGN PATENT DOCUMENTS

| | | |
|---|---|---|
| CH | 688 814 A5 | 4/1998 |
| DE | 93 15 560.3 U1 | 2/1994 |
| DE | 200 03 647 U1 | 11/1999 |
| EP | 0 812 635 A1 | 12/1997 |

* cited by examiner

*Primary Examiner*—Ed Tolan
(74) *Attorney, Agent, or Firm*—Quarles & Brady LLP

(57) ABSTRACT

An arrangement for removing dents from sheet metal contains a lever, which at a support point can be supported on the metal sheet. A handle is fitted to the lever end. To the lever can be connected a tension element, which can be connected to an adapter connected to the metal sheet.

6 Claims, 2 Drawing Sheets

ARRANGEMENT FOR REMOVING DENTS IN SHEET METAL

Figure 1:
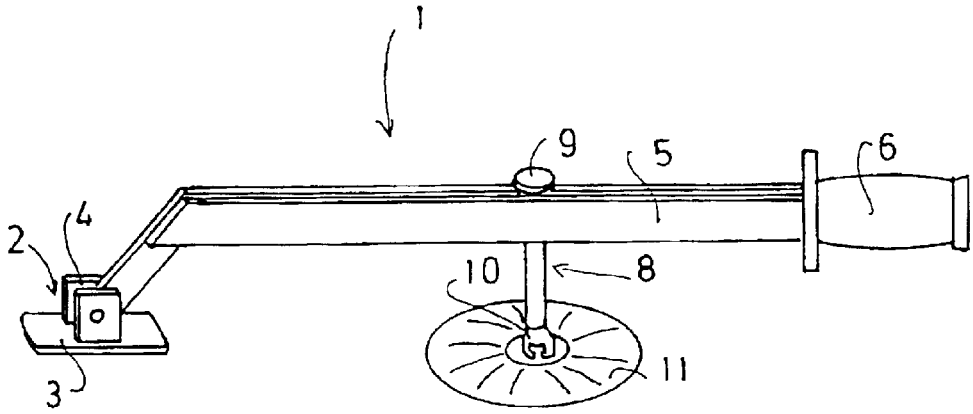

For removing concave dents from sheet metal it is known to bond an adapter into the dent and fit to said adapter a rod on which a slide block can be slid against a stop. Said slide block is referred to as a slide hammer. The slide hammer is then struck away from the dent in the direction of the body of the user and as a result the dent is drawn out of the metal sheet. The handling of said slide hammer is made somewhat more difficult, because it has to be struck in the direction of the body.

A sheet metal working device is already known (DE 296 15 666 U1), in which an adapter connectable in tension-proof manner to the lever can be slid along the latter. The front end of the adapter is welded to the dent and then the dent can be drawn out with the aid of the lever.

The problem of the invention is to create a possibility of removing dents from a metal sheet in a similar way.

To solve this problem the invention proposes an arrangement having the features of claim 1. Further developments of the invention form the subject matter of the dependent claims, whose wording is by reference made into part of the content of the description.

The tension element is fitted to the adapter, which is fixed in the dent in the same way as in the prior art and said tension element is then connected by its other end to the carrier. Tensile force can then be applied to the tension adapter by means of the carrier. The holding element can be supported at a suitable point, e.g. on the metal sheet, or on an edge or some other component.

In particular, according to a further development of the invention, the holding element is constructed as a lever, so that it can be raised about the support point, so as in this way to exert a tensile force on the tension element and therefore on the adapter bonded into the dent. The handling of said device is much simpler than in the prior art.

The lever can be a one or two-arm lever.

According to a further development of the invention, the carrier is constructed as an at least partly linearly directed rod or rail. The rod or rail can have an elongated cross-section, so as to be particularly stable in the direction in which the force is applied without rendering the weight excessive. Through the construction as a lever it is possible to achieve high forces with the arrangement, without having to support the same by an impact implement.

According to a further development of the invention, the tension element can be fitted at different positions to the carrier, which makes it possible to position the support point in accordance with the circumstances at the repair location.

According to the invention, the holding element can have a handle.

According to a further development of the invention, the tension element can be constructed in such a way that it can be fitted in captive manner to the carrier. However, it is also possible to fit it in such a way that it is fixed in a specific position from which it can then be moved into other positions. It is also possible to design the carrier in such a way that the drawing piece can be removed therefrom in a specific position.

Further features, details and advantages of the invention can be gathered from the following description of a preferred embodiment of the invention and the attached drawings, wherein show:

FIG. 1 Diagrammatically an arrangement according to the invention for removing a dent from a piece of sheet metal.

Figure 2:
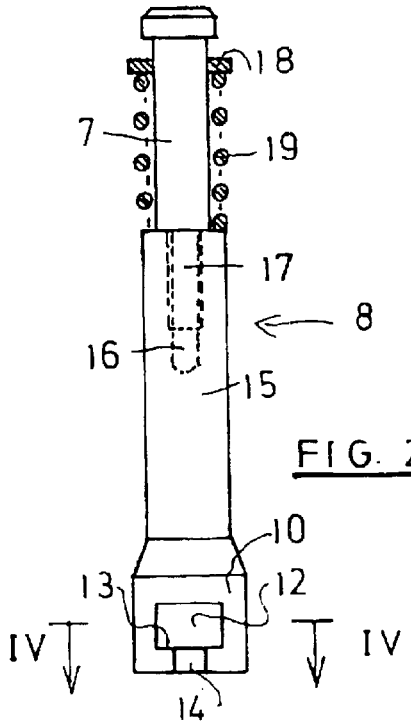

FIG. 2 Diagrammatically the side view of the tension element used with the arrangement.

Figure 3:
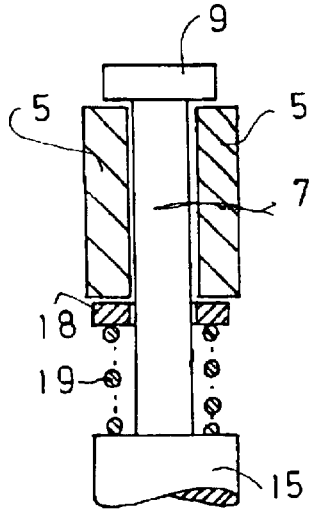

FIG. 3 On a larger scale the fitting of the tension element to the holder corresponding to a cross-section through the arrangement of FIG. 1.

Figure 4:
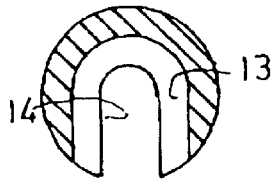

FIG. 4 A cross-section through the lower end of the tension element of FIG. 2.

Figure 5:
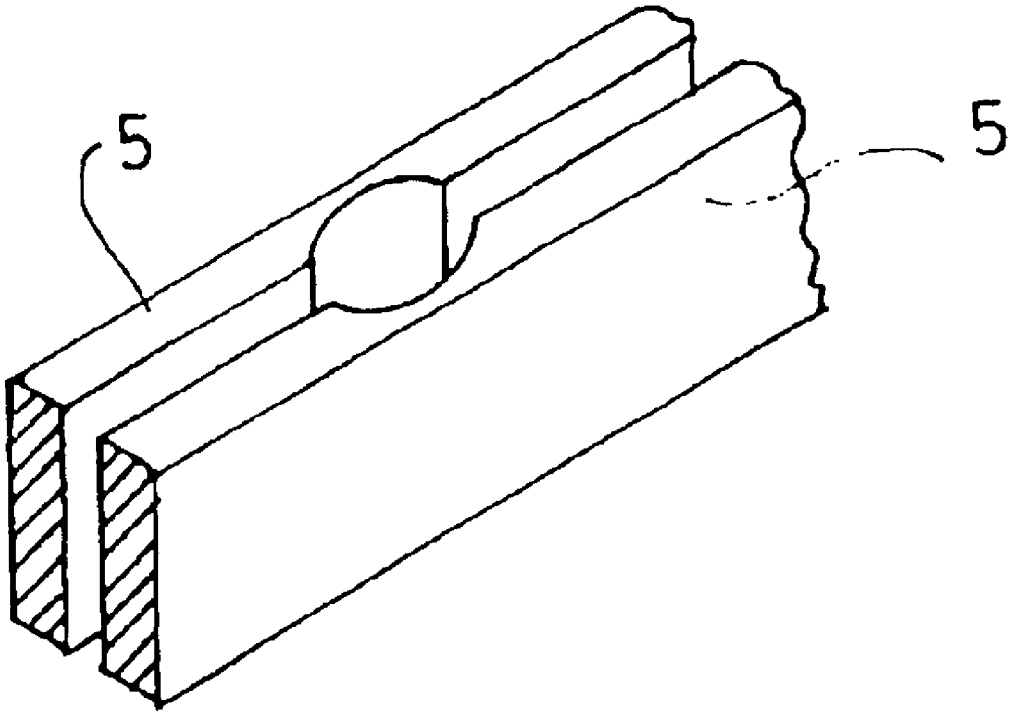

FIG. 5 A detail view of an insertion point for the tension element.

FIG. 1 perspectively shows an arrangement for removing a concave dent from a metal sheet according to the invention. The arrangement contains a holding element 1, which is at one end supported on a support point 2. The support point 2 contains a flat plate 3, which is placed on a corresponding stable point. On its underside the plate 3 can have a coating preventing sliding or slipping away, e.g. of an elastomeric material. In a joint arrangement, the carrier constructed as a one-arm lever is articulated to the support 2. The carrier 1 is constructed over a large part of its length as a linear rail, which has two cross-sectionally rectangular, parallel, mutually spaced metal sections 5. At the end opposite to the support point 2 is fitted to the holding element 1 a handle 6, which can be gripped by a user.

The shaft 7 of a tension element 8 is passed between the two metal sections 5. The head 9 of the tension element 8 has a larger diameter than the spacing between the two metal sections 5, so that the tension element 8 is connected in tension-proof manner to the carrier.

At its opposite, lower end the tension element is provided with a claw 10, with which it can be hung in tension-proof manner in the head of a tension adapter 11. The tension adapter 11 is bonded beforehand into the dent which is to be dedented. If the fitter grips the handle 6 and pivots the carrier upwards, drawing or pulling takes place on the tension adapter 11 and therefore on the metal sheet, so that it is possible to draw out the dent. It is optionally possible to strike the edge of the dent assisted by a hammer, which leads to a higher stiffness of the restored metal sheet.

FIG. 2 shows the tension element 8 in greater detail. At its end associated with the tension adapter 11 is formed a claw 10, which contains an opening 12 open to one side. The transverse dimension corresponds to the dimension of the head fitted to the tension adapter 11. Below the opening 12 shoulders 13 are formed on either side and a slot 14 remains free between them. The width of the slot 14 corresponds to the diameter of the head on the tension adapter 11. The cross-section of FIG. 4 shows how the shoulders 13 surround the slot 14.

An axial bore 16, coaxial to the shaft part 15 and containing an internal thread, is made in the first shaft part 15 following onto the claw 10 from the side remote from said claw 10. The second part of the tension element 8 provided with a threaded lug 17 is screwed with the shaft 7 into the internal thread. The tension element could also have a different construction.

Prior to installation a packing shim 18 is placed on the shaft 7 and a helical compression spring 19 is mounted. The helical compression spring 19 presses the packing shim 18 in the direction of the tension element head 9. On introducing the tension element into the carrier, the metal sections 5 are secured between the packing shim 18 and the tension element head 9. As a result the tension element 8 is fixed at a specific point of the carrier, so that the device is easier to handle. Fixing is chosen in such a way that the tension element can also slide, if necessary. Through the construction of the carrier from two parallel, spaced metal sections 5, the tension element 8 can be slid backwards and forwards at random. On the one hand this makes it possible to modify the lever arm and on the other ensure that the support point can be provided on a suitable substrate.

FIG. 1 shows a one-arm lever. It would obviously also be possible to construct the carrier for the tension element 8 as a two-arm lever, when the other lever arm would then have to be pressed downwards.

The fitting of the element 8 to a carrier can e.g. take place in that the upper part of the tension element provided with the thread 17 is firstly engaged between the sections 5 and then screwed into the shaft 15.

However, it is also possible to e.g. remove the handle 6, so that the tension element can be slid in between the metal sections 5 from the end which then has no handle.

The holder can e.g. have a point where the spacing between the two metal sections is increased, so that at this point the tension element head can be engaged through and such a possibility is shown in simplified form in FIG. 5. Both sections 5 have a semicircular notch, which together form an opening. At this point the tension element head can be engaged through.

What is claimed is:

1. Arrangement for removing dents from metal sheets, having a holding element (1) including a carrier (5) with at least one elongated carrier member, and at least one support (2) and the holding element (1) being supported on the support (2) and having a tension element (8), which at one end is connectable in tension-operable manner to a non-invasive tension adapter (11) fitted in the dent and adapted to apply a pulling force on the dent, and in the vicinity of an opposite end is connectable with the holding element (1), wherein the holding element is constructed as a lever with at least one arm, and wherein the tension element (8) has a claw with a slotted opening for receiving a head of the tension adapter (11), wherein the tension element (8) and the holding element are adapted to be connected to the tension adapter (11) in a selected one of a plurality of different positions; and wherein the carrier is slidably connected to the tension element (8), the tension element including a spring-urged member (18) which is urged against the carrier (5) in a transverse direction, and the tension element (8) including a retainer (7,9) that extends through the carrier (5) from the spring-urged member (18) to slidably connect to the carrier (5).

2. Arrangement according to claim 1, wherein the holding element is constructed as an at least partly linearly directed rod or rail.

3. Arrangement according to claim 1, wherein the holding element has a handle (6).

4. Arrangement according to claim 1, wherein the tension element (8) is fitted in captive manner to the holding element.

5. Arrangement according to claim 1, wherein a position of the tension element along the holding element is relocatable.

6. Arrangement according to claim 5, wherein the tension element (8) is connected to the carrier (5) with a clamping action, particularly with the aid of the spring.

* * * * *